US006134931A

United States Patent [19]

Glaesener

[11] Patent Number: 6,134,931

[45] Date of Patent: Oct. 24, 2000

[54] PROCESS AND APPARATUS FOR FORMING A SHAPED ARTICLE

[75] Inventor: Pierre Glaesener, Bissen, Luxembourg

[73] Assignee: Husky Injection Molding Systems Ltd., Canada

[21] Appl. No.: 09/320,116

[22] Filed: May 26, 1999

[51] Int. Cl.[7] ..... B21D 26/02

[52] U.S. Cl. ..... 72/58; 72/61; 29/421.1

[58] Field of Search ..... 72/58, 61, 62; 29/421.1

[56] References Cited

U.S. PATENT DOCUMENTS

| | | | |
|---|---|---|---|
| 4,744,237 | 5/1988 | Cudini | 72/61 |
| 5,070,717 | 12/1991 | Boyd et al. . | |
| 5,157,969 | 10/1992 | Roper . | |
| 5,339,667 | 8/1994 | Shah et al. . | |
| 5,372,027 | 12/1994 | Roper et al. . | |
| 5,431,326 | 7/1995 | Ni et al. | 72/61 |
| 5,557,961 | 9/1996 | Ni et al. | 72/61 |
| 5,620,723 | 4/1997 | Glaesener et al. . | |
| 5,624,695 | 4/1997 | Glaesener et al. . | |
| 5,645,875 | 7/1997 | Glaesener et al. . | |
| 5,715,718 | 2/1998 | Rigsby et al. . | |
| 5,799,524 | 9/1998 | Schafer et al. . | |
| 5,845,382 | 12/1998 | Schultz et al. | 72/61 |
| 5,868,989 | 2/1999 | Glaesener et al. . | |
| 5,987,950 | 11/1999 | Horton | 72/58 |
| 6,014,879 | 1/2000 | Jaekel et al. | 72/61 |
| 6,016,603 | 1/2000 | Marando et al. | 72/61 |
| 6,018,971 | 2/2000 | Kleinschmidt | 72/61 |

FOREIGN PATENT DOCUMENTS

| | | |
|---|---|---|
| 4434441 | 3/1996 | Germany . |

*Primary Examiner*—David Jones
*Attorney, Agent, or Firm*—Bachman & LaPointe, P.C.

[57] ABSTRACT

A mold is provided having a mold cavity in the final shape of an article and a hollow article is placed in the mold adjacent the mold cavity. The hollow article is preformed into an intermediate shape by closing the mold around the hollow article, and then formed into the final shape by introducing fluid pressure into the preformed hollow article to conform the preformed hollow article into the shape of the mold cavity.

18 Claims, 3 Drawing Sheets

PROCESS AND APPARATUS FOR FORMING A SHAPED ARTICLE

BACKGROUND OF THE INVENTION

The present invention relates to the hydroforming of a material in a two-stage operation so that the material is first preformed followed by final forming into the desired final shape.

Hydroforming is a procedure for shaping material, usually a metal, within a closed mold by subjecting the material to high fluid pressure, as the fluid pressure of a liquid, so that the material is permanently deformed against a mold surface.

U.S. Pat. No. 5,157,969 to Roper, U.S. Pat. No. 5,372,027 to Roper et al., U.S. Pat. No. 5,715,718 to Rigsby et al., U.S. Pat. No. 5,799,524 to Schafer et al. are all examples of hydroforming of materials. The '524 and '718 patents discuss hydroforming of a hollow workpiece, but neither reference teaches preforming the workpiece prior to final forming by using the pressure internally.

In addition to the foregoing, the following U.S. patents show a two platen clamp having tiebars engaged by rotating hydraulic clamp pistons: U.S. Pat. Nos. 5,624,695, 5,645,875 and 5,620,723 all to Glaesener et al. and U.S. Pat. No. 5,868,989 to Glaesener.

It is a principal object of the present invention to provide an improved process and apparatus for forming a shaped article.

It is a further object of the present invention to provide a process and apparatus as aforesaid which efficiently and expeditiously forms a shaped article by a two stage operation including finally hydroforming a hollow article at high internal pressure.

Further objects and advantages of the present invention will appear hereinbelow.

SUMMARY OF THE INVENTION

In accordance with the present invention, it has now been found that the foregoing objects and advantages are readily obtained.

In accordance with the present invention, a process for forming a shaped hollow article is provided, which comprises: providing a mold having a mold cavity in the final shape of an article; placing a hollow article, generally metal, to be shaped in said mold adjacent the mold cavity; preforming said hollow article into an intermediate shape by closing the mold around the hollow article to be shaped; and forming the final shape by introducing fluid pressure, generally high fluid pressure from 20,000 to 120,000 psi, into said preformed hollow article while the mold is in the closed condition to conform the preformed article to the shape of the mold cavity.

The present invention also provides an apparatus for forming a shaped hollow article which comprises: a mold having a mold cavity in the final shape of an article, a hollow article to be shaped in said mold adjacent said mold cavity; means to close said mold around the hollow article to be shaped to preform said hollow article to be shaped into an intermediate shape; and means to introduce fluid pressure into said preformed hollow article while the mold is in the closed condition to conform the preformed hollow article to the shape of the mold cavity and form the final shape.

Further features and advantages of the present invention will appear hereinbelow.

BRIEF DESCRIPTION OF THE DRAWINGS

The present invention will be more readily understandable from a consideration of the accompanying exemplificative drawings, in which.

DETAILED DESCRIPTION OF PREFERRED EMBODIMENTS

Figure 1:
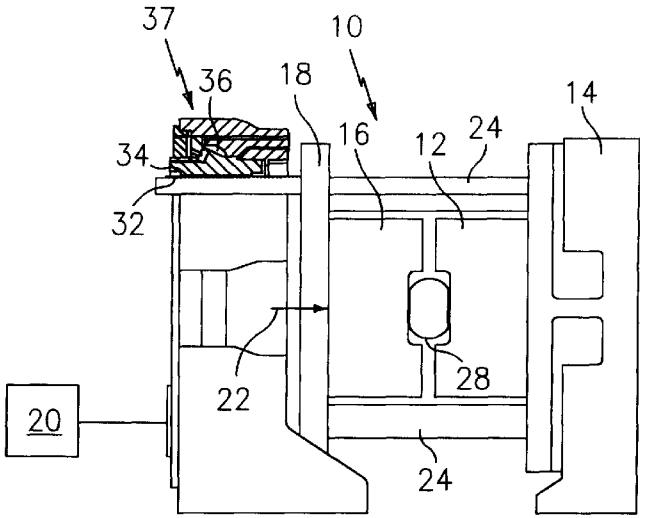
FIGS. 1–4 are sectional views showing four operating stages, including preforming and final hydroforming.

Referring to the drawings, FIGS. 1–4 show a series of stages in the formation of a shaped, hollow article by first preforming the hollow article to be shaped, as a hollow tube or tube-like member, into an intermediate shape in a mold closing step, followed by hydroforming the preformed article in a closed mold.

FIG. 1 shows mold 10 having stationary mold half 12 mounted on stationary platen 14 and movable mold half 16 mounted on movable platen 18. The movable platen 18 and movable mold half 16 are moved by motive means 20 shown schematically in the direction of arrow 22 on tiebars 24. In the mold closed position shown in FIG. 2 the mold halves together form mold cavity 26 which has the shape and configuration of the desired final article.

The article to be formed may be any formable material, desirably metal such as steel. However, naturally other formable materials may be used as copper, nickel, aluminum, etc. In addition, the article to be formed is a hollow article, such as a hollow tube or tube-like article. Naturally, the exact shape and configuration of the article to be formed will depend on the final desired shape to be prepared.

Figure 2:
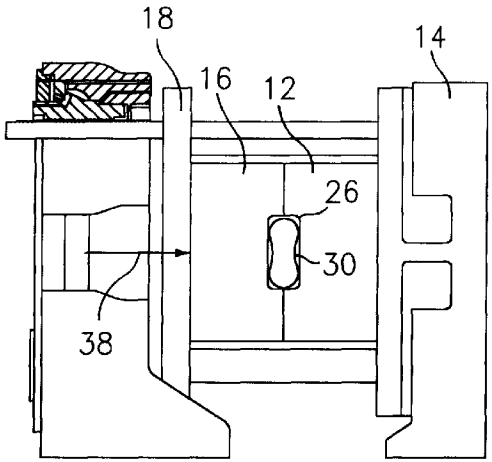

Referring to FIG. 1, the hollow article to be shaped, as hollow steel tube 28, is first positioned between the open mold halves which are then partially closed for partial forming of the article as shown in FIG. 1. The mold halves are then closed as shown in FIG. 2 to preform the hollow article into intermediate shape 30 which represents the beginning of the deformation of the hollow article into the final desired shape. Tiebars 24 are fixed to stationary platen 14 and include grooves or notches 32 that engage rotary clamp piston 34. The clamp piston is mounted inside clamp cylinder 36 which is housed inside moving platen 18. There are four (4) such similar tiebar/piston assemblies 37 mounted at the corners of the platens to provide the required clamping force as shown by arrow 38 in FIG. 2; however, additional tiebar/piston assemblies can be used if additional clamping force is desired. Also, other means may be used, if desired, to provide the required clamping force, but the illustrated embodiment is a preferred mechanism.

FIG. 2 shows the completion of the preforming operation with the mold in the mold closed position and the hollow article 28 preformed or partially deformed into intermediate shape 30 by the action of mold halves 12 and 16.

Figure 3:
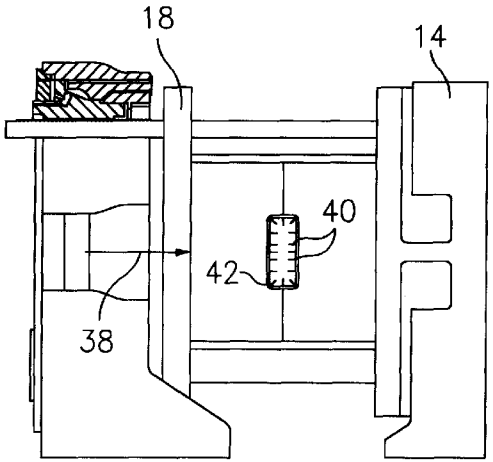

FIG. 3 shows the final forming or hydroforming operation wherein high fluid pressure from 20,000–120,000 psi is supplied to the interior of the preformed intermediate shape 30 in the direction of arrows 40 to deform and press the hollow article against the interior surfaces of the closed and clamped mold and form finished article final shape 42. If a steel hollow article is used, the high fluid pressure is desirably from 80,000–120,000 psi. The very high pressure used for the hydroforming process requires that the tiebar/piston assemblies 37 counteract the force trying to open the mold. The hollow article is permanently deformed by this internal action.

Figure 4:
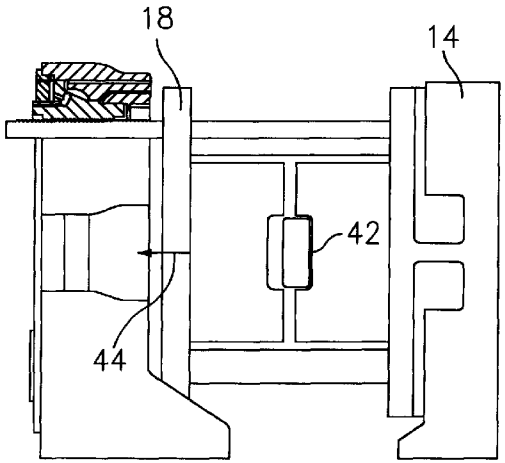

FIG. 4 shows the mold opening operation wherein the movable platen 18 is moved in the direction of arrow 44 so that finished article 42 can be removed from the mold and the cycle can be repeated.

Figure 5:
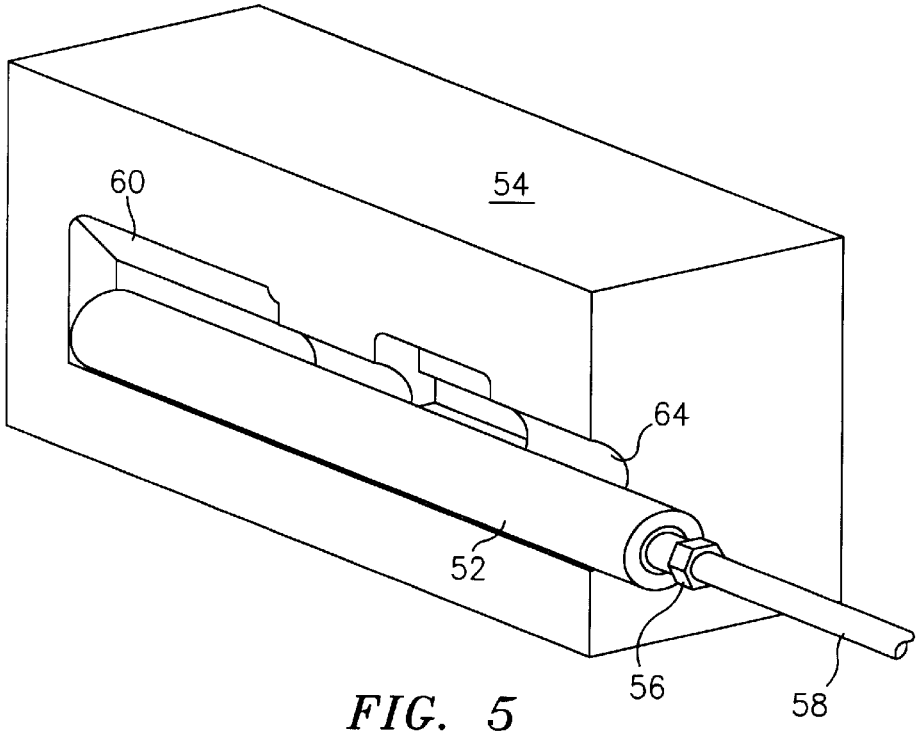
FIGS. 5–7 are perspective views showing a final article as it is formed.
Figure 6:
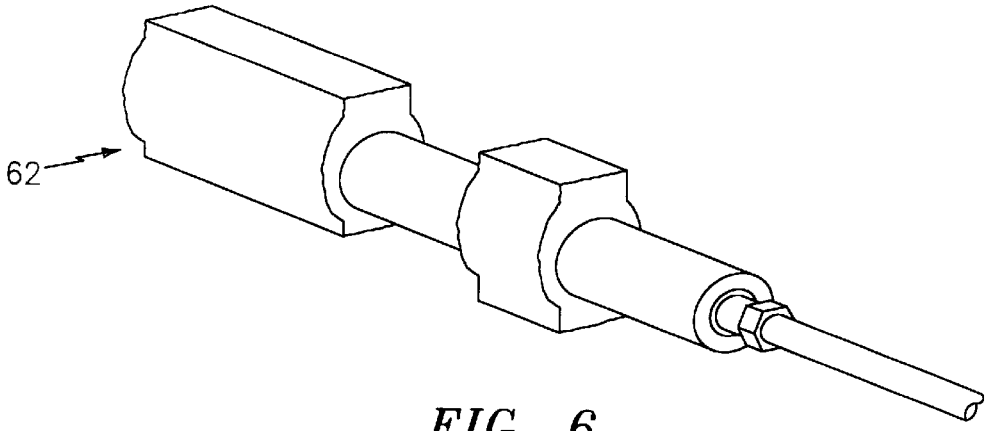
Figure 7:
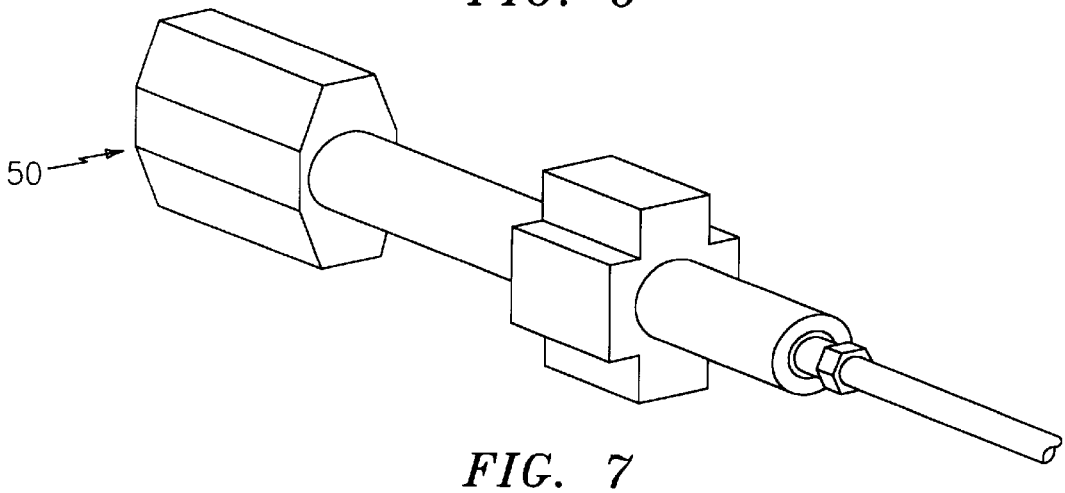

FIGS. 5–7 show a series of perspective views as the article is formed, with the final formed article 50 shown in FIG. 7. FIG. 5 shows a tubular, hollow blank 52, as a steel tube, and one half of a mold 54. The blank is for example a length of steel tubing closed at both ends. Connected to one end of blank 52 is a high fluid pressure fitting 56 and a fluid pressure supply line 58 connected to a source of high pressure fluid (not shown) supplying fluid pressure as described in connection with FIGS. 1–4. Mold half 54 contains one half of mold cavity 60 in the shape of the final article. The same procedure is then followed as in FIGS. 1–4, wherein FIG. 6 shows the intermediate shape 62 after preforming wherein the closing action of the mold at low pressure partially forms the blank into the intermediate shape. FIG. 7 shows the final shape of the final formed article 50 after hydroforming at high pressure, i.e., for the steel tube at a pressure of 80,000–120,000 psi, wherein the internal pressure presses the preformed blank against the interior surface of the mold cavity to form the finished article. Part of the article provides a connection area for mounting the high fluid pressure fitting 56. If desired, this part of the blank can be removed from the finished article in a later operation. In addition, a cutout area 64 is provided in the mold to provide access for the supply of the high pressure fluid. Because the high pressure fluid is contained within the blank there is no sealing requirement for cutout 64.

Figure 8:
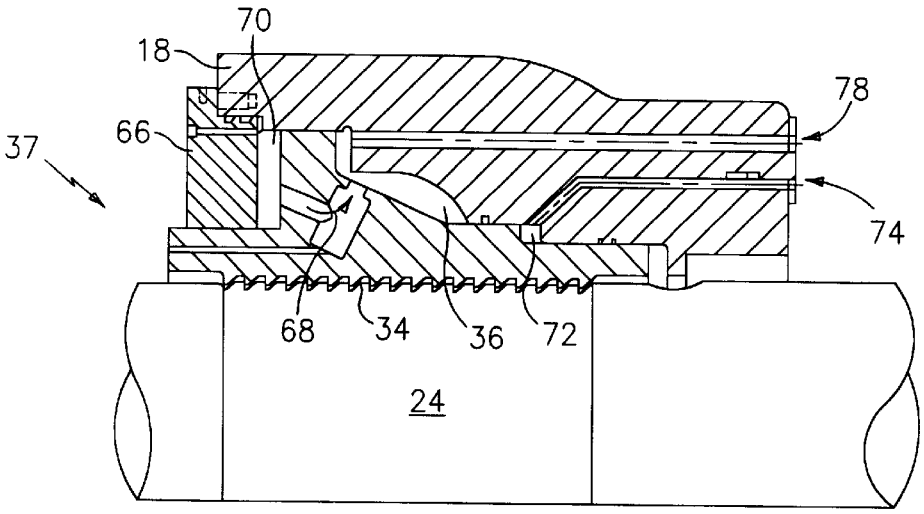
FIGS. 8–10 are sectional views through a clamp piston of the press showing three positions during the operation.
Figure 9:
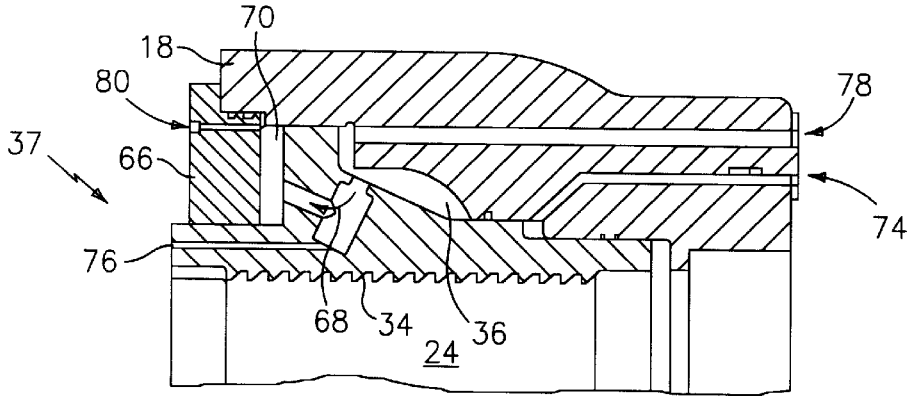
Figure 10:
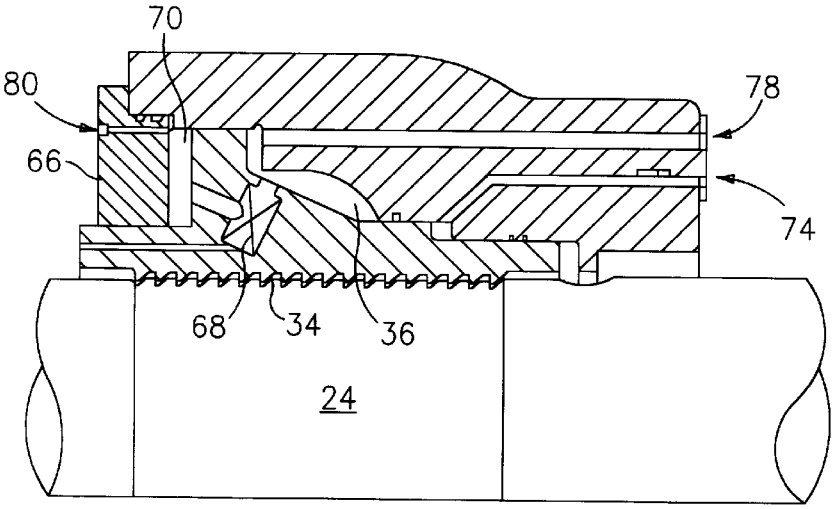

FIGS. 8–10 show the details of the tiebar/piston assemblies 37. FIG. 8 shows an enlarged section of clamp piston 34 inside clamp cylinder 36 located in movable platen 18. Cylinder plate or cover plate 66 is fastened to the movable platen and encloses the clamp cylinder. Clamp piston 34 contains a pilot operating cartridge valve 68 shown schematically in FIG. 8 permitting flow of oil from positioning cylinder 70 to clamp cylinder 36. Preforming cylinder 72 has an area slightly less than the difference in areas between cylinder 36 and cylinder 70. Typically, cylinder 72 has a projected area of approximately 15% of the projected area of cylinder 36. Consequently, when high pressure oil is supplied to cylinder 72 via channel 74, piston 34, with its teeth engaged, causes a preforming force to be applied to the open mold causing it to close and preform the article between the mold halves. This force will be approximately 15% of the clamp force of the press. As the clamp piston 34 moves inside cylinder 36, the oil on either side of the clamp piston moves through valve 68 equalizing the hydraulic pressure on either side of clamp piston 34.

FIG. 9 shows the hydroforming stage wherein the maximum clamp up force is supplied to keep the mold closed. Here valve 68 is closed by providing pressure via channel 76. A second supply of high pressure oil is provided via channel 78 and acts inside cylinder 36, thereby adding more clamp force to keep the mold closed during the hydroforming process. Cylinder 70 is vented to a tank via line 80 so that as the clamp piston 34 moves the oil in cylinder 70 is not pressurized and does not hinder the movement of piston 34 as it acts to develop clamp force.

FIG. 10 shows the mold break and repositioning of the clamp piston portion of the cycle. Here, high pressure oil is supplied to positioning cylinder 70 via channel 80 to cause the clamp piston 34, still engaged via tiebar teeth to the tiebar 24, to force the mold to begin to open. This is called "mold break" and is the force provided to release any sticking of the article inside the closed mold that may resist opening of the mold. Mold break is required to operate for a small initial portion of the mold stroke, typically 1–3 inches. Thereafter, mold opening is completed by the action of mold stroke cylinders (not shown). During mold break valve 68 is opened to allow oil in the clamp cylinder 36 to pass into cylinder 70. Because cylinder 70 has a greater projected area than cylinder 36, there is a net force of about 10% of the clamp force available for mold break. Cylinder 72 is vented to a tank via line 74, thereby allowing clamp piston 34 to move unopposed during mold break.

After mold break has been completed, the oil pressure in all the cylinders 36, 70 and 72 is released and the clamp piston 34 is rotated to disengage its teeth from those of tiebar 24, thereby allowing the mold stroke cylinders to complete the mold opening as previously described. Prior to re-engaging the teeth of the clamp piston 34 with tiebar 24, the axial position of the piston within cylinder 36 is adjusted to insure that the teeth on the piston are aligned with the spaces between the teeth on the tiebar. This is done in a known fashion be supplying pressurized oil to either side of clamp piston 34 via cylinders 36 and 70 as required.

Thus, the present invention provides a process and apparatus for forming an article include a preforming stage which operates at a low pressure followed by a hydroforming or high pressure forming stage. This will effectively and efficiently from a final desired shape in a hollow article. In addition, a clamp is provided having two stages of operation with each requiring different magnitudes of clamping force.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Process for forming a shaped hollow article, which comprises:

providing a mold having a mold cavity in the final shape of an article;

placing a hollow article to be shaped in said mold adjacent the mold cavity;

preforming said hollow article into an intermediate shape by closing the mold around the hollow article to be shaped; and forming the final shape by introducing fluid pressure into preformed hollow article while the mold is in the closed condition to conform the preformed hollow article to the shape of the mold cavity, including forming the mold cavity by mold halves which are fixed to platens and moving at least one of said mold halves on tiebars.

2. Process according to claim 1, including the step of placing a hollow metal article to be shaped into said mold.

3. Process according to claim 2, including the step of placing a hollow steel article to be shaped into said mold.

4. Process according to claim 1, including the step of placing a hollow tub e to be shaped into said mold.

5. Process according to claim 1, including the step of forming the final shape by introducing high fluid pressure from 20,000 to 120,000 psi into said hollow article.

6. Process according to claim 5, including the step of placing a hollow steel tube to be shaped into said mold and forming the final shape by introducing high fluid pressure from 80,000 to 120,000 psi into said preformed hollow steel tube.

7. Process according to claim 1, including the step of providing clamping force to said mold by at least one clamp piston that engages at least one of said tiebars.

8. Process according to claim 7, including providing clamping force to said clamp piston by clamp cylinders that act on the clamp piston.

9. Process according to claim 8, including providing clamping force on said clamp piston having two stages of operation each requiring different magnitudes of clamping force.

10. Apparatus for forming a shaped hollow article, which comprises:

a mold having a mold cavity in the final shape of an article;

a hollow article to be shaped in said mold adjacent the mold cavity;

means to close said mold around the hollow article to be shaped to preform said hollow article to be shaped into an intermediate shape; and means to introduce fluid pressure into said preformed hollow article when the mold is in the closed condition to conform the preformed hollow article to the shape of the mold cavity and form the final shape, wherein the mold cavity is formed by mold halves which are affixed to platens, and wherein at least one of said mold halves is a movable mold half movable on tiebars.

11. Apparatus according to claim 10, wherein the hollow article to be shaped is a metal article.

12. Apparatus according to claim 11, wherein the hollow article to be shaped is a steel article.

13. Apparatus according to claim 10, wherein the hollow article to be shaped is a hollow tube.

14. Apparatus according to claim 10, including means to introduce fluid pressure from 20,000 to 120,000 psi into said hollow article.

15. Apparatus according to claim 14, including a hollow steel tube to be shaped in said mold adjacent the mold cavity, and means to introduce fluid pressure from 80,000 to 120,000 psi into said preformed hollow steel tube.

16. Apparatus according to claim 10, including at least one clamp piston that engages at least one of said tiebars to provide clamping force to said mold.

17. Apparatus according to claim 16, including clamp cylinders that act on the clamp piston to provide clamping force to the clamp piston.

18. Apparatus according to claim 17, including means to provide clamping force on said clamp piston having two stages of operation each requiring different magnitudes of clamping force.

* * * * *

UNITED STATES PATENT AND TRADEMARK OFFICE

CERTIFICATE OF CORRECTION

PATENT NO. : 6,134,931
DATED : October 24, 2000
INVENTOR(S) : Pierre Glaesner

It is certified that error appears in the above-identified patent and that said Letters Patent is hereby corrected as shown below:

COLUMN 4:
Claim 4, line 59, "tub e" should read --tube--;

COLUMN 6:
Claim 15, line 14, "120," should read --120,000--;

COLUMN 6:
Claim 15, line 15, "000" should be deleted.

Signed and Sealed this

Twelfth Day of June, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,134,931
DATED : October 24, 2000
INVENTOR(S) : Pierre Glaesner

It is certified that error appears in the above-identified patent and that said Letters Patent is hereby corrected as shown below:

Column 4, claim 4,
Line 59, "tub e" should read --tube--;

Column 6, claim 15,
Line 14, "120," should read --120,000--;
Line 15, "000" should be deleted.

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*